US005106263A

United States Patent [19]

Irie

[11] Patent Number: 5,106,263

[45] Date of Patent: Apr. 21, 1992

[54] CENTRIFUGAL PUMP WITH HIGH EFFICIENCY IMPELLER

[75] Inventor: Masao Irie, Yokohama, Japan

[73] Assignee: Jidosha Denki Kogyo K.K., Kanagawa, Japan

[21] Appl. No.: 586,112

[22] Filed: Sep. 21, 1990

[30] Foreign Application Priority Data

Sep. 22, 1989 [JP] Japan ..... 1-247779

[51] Int. Cl.[5] ..... F01D 1/02

[52] U.S. Cl. ..... 415/206; 415/106; 416/223 B

[58] Field of Search ..... 415/104, 106, 121.1, 415/121.2, 200, 203, 204, 206; 416/93 R, 223 R, 223 A, 223 B

[56] References Cited

U.S. PATENT DOCUMENTS

| | | | |
|---|---|---|---|
| 865,900 | 9/1907 | Hunsaker | 415/106 |
| 2,244,397 | 6/1941 | La Bour | 415/204 |
| 2,658,455 | 11/1953 | Seinfeld | 415/106 |
| 3,676,014 | 7/1972 | Bevan et al. | 415/200 |
| 4,826,398 | 5/1989 | Gullichsen | 415/121.1 |

FOREIGN PATENT DOCUMENTS

| | | | |
|---|---|---|---|
| 0139990 | 2/1948 | Australia | 416/223 B |
| 0568031 | 12/1958 | Canada | 415/206 |
| 0732255 | 2/1943 | Fed. Rep. of Germany | 416/223 R |
| 2011536 | 10/1970 | Fed. Rep. of Germany | 415/200 |
| 2050170 | 4/1972 | Fed. Rep. of Germany | 415/203 |
| 0690118 | 9/1930 | France | 416/223 B |
| 0508925 | 1/1955 | Italy | 415/206 |
| 62-150100 | 7/1987 | Japan . | |
| 0084596 | 3/1957 | Netherlands | 416/223 B |
| 0100268 | 7/1923 | Switzerland | 416/223 R |

*Primary Examiner*—Edward K. Look
*Assistant Examiner*—Christopher M. Verdier
*Attorney, Agent, or Firm*—Sughrue, Mion, Zinn, Macpeak & Seas

[57] ABSTRACT

A small-sized centrifugal pump is improved in its efficiency and performance by having an impeller the height of which is higher than theoretically calculated value and decreases in the circumferential direction from the central portion, and which has a flow channel with a narrow and constant width.

7 Claims, 7 Drawing Sheets

CENTRIFUGAL PUMP WITH HIGH EFFICIENCY IMPELLER

BACKGROUND OF THE INVENTION

1. Field of the Invention

This invention relates to a small-sized centrifugal pump suitable for an electric motor-driven washer pump for supplying a washing agent in order to clean a windshield or a head lamp of motor vehicles and, more particularly to a small-sized centrifugal pump suitable to obtain excellent pump performance with high efficiency in a centrifugal pump of the low-specific speed type.

2. Description of the Prior Art

In the case of cleaning a windshield or a head lamp of motor vehicles by spraying a washing agent supplied by using an electric motor-driven washer pump, it is necessary to clean efficiently with a small amount of the washing agent since the washing agent is stored in a reservoir and is limited in quantity. For example, a washing agent having a flow rate of about 280 cc/10 sec is sprayed at a pressure of about 1.5 kgf/cm$^2$ in the case of a windshield washer pump, and the a washing agent having a flow rate of about 1000 cc/10 sec is sprayed at a high pressure of about 3.0 kgf/cm$^2$ in the case of a head lamp cleaner pump, and in either case the specific speed of the pump is so low as to be less than 80.

Presently, a centrifugal pump, a vane pump and a gear pump are cited as the type of pump used for the washer pump. Among them, the centrifugal pump is used generally except for one used under special conditions. The reason why the centrifugal pump is used is that it can be produced easily at a low price, and it is not so noisy because it is not a contact type. However, in the centrifugal pump, it is necessary to design an impeller to lower its height against the diameter of the impeller in order to decrease the specific speed of the pump. Therefore, a flow channel in the impeller becomes flat, and the efficiency of the pump drops drastically due to a loss due to circulation in the flow channel or a loss due to separation caused at the surface of a blade of the impeller.

Especially, in case of the washer pump having an impeller with a diameter of 30 mm or so, exit height $h_2$ (height at the circumference) of an impeller 51 shown in FIG. 11(*a*) is calculated to be not more than 1 mm according to theoretical calculations. Accordingly, a leakage loss in the pump housing becomes serious in addition to the deterioration of the performance because a ratio ($h_2$/c) of the exit height $h_2$ of the impeller 51 to a clearance c of a pump housing, and the desired high performance can not be obtained. Such a tendency is more remarkable the move since the size of the washer pump is small.

Therefore, in the conventional washer pump, the impeller 51 is designed so that height H of the impeller 51 is 4~6 mm or so, as shown in FIG. 11(*b*), and the pump intentionally has a specific speed which is set higher than the theoretical calculation. In such a case, it is possible to obtain the good performance, but the losses caused by the separation and the circulation are remarkable and it is impossible to obtain the high efficiency because the capacity of the impeller (volume of the flow channel of the impeller) is larger than the theoretical value. Namely, the pump efficiency is of secondary importance, and obtaining the required performance of the pump is prior to the pump efficiency.

For example, a pump designed by optimizing the impeller diameter and the position of an outlet hole of the pump in order to improve the pump efficiency is disclosed in Japanese Patent Disclosure (Kokai) No. 62-15011/87. However, the method is merely a means for converting the velocity energy given by the impeller into the pressure energy effectively. Therefore, it is not a radical measure to obtain the highly efficient pump because the efficiency of the impeller itself is not improved.

In the conventional impeller 51, the fluid does not flow along the blade, the distribution of pressure in the flow channel becomes uniform and the separation and the circulation occur because the flow channel between the blades is spread outwardly from the center portion as shown in FIG. 11 (*c*), and the loss in the impeller is caused by these phenomena. There is also a problem in that the deterioration of the efficiency is caused by rotating the excessive fluid wastefully in the impeller 51 because the impeller 51 has a shape suitable for higher specific speed (a shape having a higher height for the impeller) and the volume of the flow channel in the impeller 51 is larger than necessity.

SUMMARY OF THE INVENTION

This invention is made in view of the above mentioned problem of the prior art and an object of the invention is to provide a small-sized centrifugal pump of the low-specific speed type having high pump efficiency as well as good performance.

The construction of the small-sized centrifugal pump according to this invention for attaining said object is characterized in that it has a motor part, a pump part, an impeller provided in the pump part and rotated by said motor part, and said impeller has a decreasing height in the circumferential direction from the central portion thereof and a flow channel with substantially constant width W leading from the central portion to the circumference thereof.

In the small-sized centrifugal pump according to an aspect of this invention, it is preferable that a ratio ($W/h_1$) of width W to height $h_1$ of said flow channel at the central portion of the impeller is in the range of 0.5 to 1.2. In the small-sized centrifugal pump according to the other aspects of this invention, it is preferable that the flow channel is formed by two arcs of coaxial circles or two involutes so as to maintain the width W thereof substantially constant. It is desirable that the height at the circumference of the impeller is in the range of one-seventh to one-fourth of the diameter of the impeller in another aspect of this invention. Furthermore, in the small-sized centrifugal pump according to another aspect of this invention, it is preferable to provide a balance hole in the vicinity of a boss of the impeller in order to solve the pressure difference caused between the front and the rear of the impeller and to further improve the pump efficiency, and it is further preferable that the area of the balance hole is in the range of 25% to 50% of the entrance area of the impeller in total.

In the small-sized centrifugal pump according to this invention having the aforementioned construction, occurrence of separation and the circulation in the impeller is prevented because the flow channel is so formed as not to spread the width W outwardly from the central portion of the impeller. The flow area of the flow channel decreases in the circumferencial direction by making the flow channel so as not to spread in width W and making the impeller so as to decrease the height of the impeller in the circumferential direction, whereby the fluid is accelerated as the fluid flows toward the exit from the entrance in the impeller. Accordingly, the change of the flowing area of the flow channel accords with the flow of the fluid and so the occurrence of the separation is prevented. Furthermore, the highly efficient pump characteristics are obtained because the flow channel of the impeller is so formed that the volume of the flow channel is nearly equal to the theoretically calculated value, and so the fluid does not flow excessively.

DETAILED DESCRIPTION OF THE INVENTION

This invention will be explained below in reference to the drawings.

Figure 1:
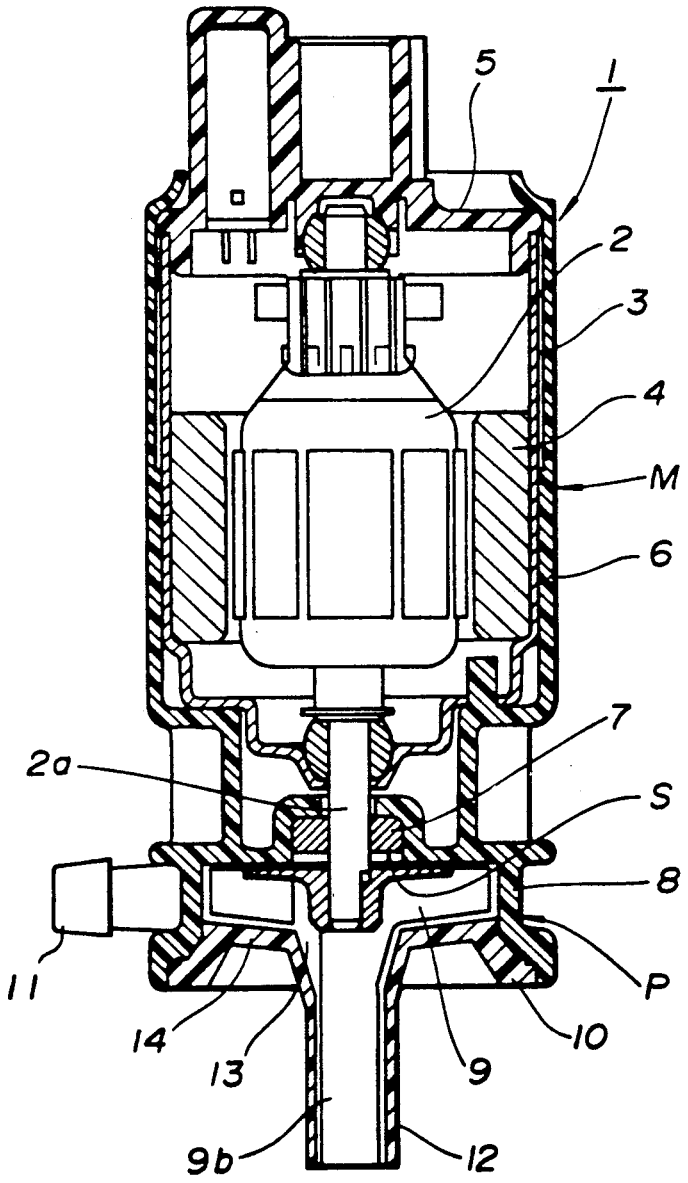
FIG. 1 is a vertical sectional view of the washer pump showing an embodiment of the small-sized centrifugal pump according to this invention.
Figure 2:
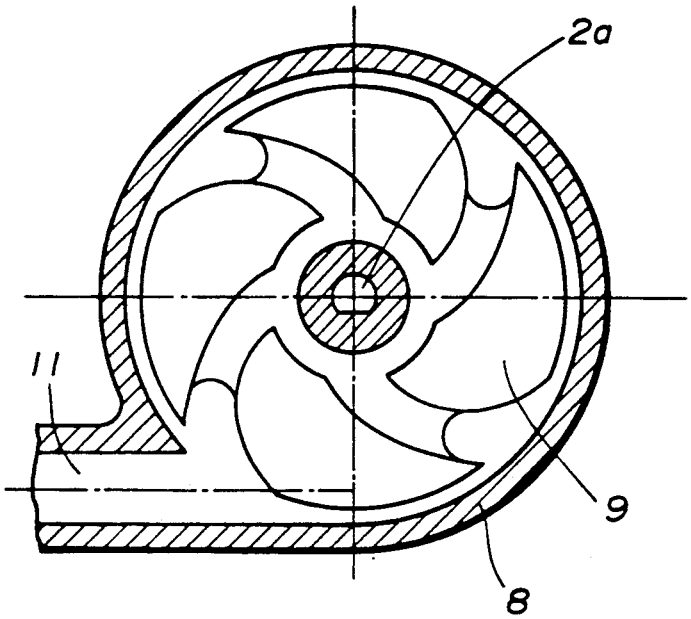
FIG. 2 is a transverse sectional view of the pump housing of the washer pump shown in FIG. 1.

FIG. 1 to FIG. 4 are drawings showing an embodiment of this invention. FIG. 1 is a vertical sectional view of the washer pump showing an embodiment of the small-sized centrifugal pump according to this invention. A washer pump 1 is provided with a pump part P, a motor part M for driving the pump part P and a water sealing part S for preventing inflow of a washing agent into the motor part M from the pump part P.

Among them, the motor part M comprises mainly an armature 2, a yoke 3, a magnet 4, a holder base 5 and a motor case 6 for housing them. The motor case 6 houses the motor part M, serves both as an attaching part for a water seal 7 forming the water sealing part S and a pump case 8, and is formed by monoblock molding with synthetic resin.

The motor part M and the motor case 8 are set up coaxially and one end of a shaft 2*a* of the armature 2 extends into the pump case 8 through the water seal 7.

The pump part P comprises mainly the pump case 8, an impeller and a pump cover 10. The pump case 8 is molded in one body with the motor case 6 by using synthetic resin as described above. In the pump part P, the pump case 8 has a circular cross section and is coaxial with the motor shaft 2*a*. The pump case 8 is provided with an outlet 11 in the direction of a tangential line. A pump cover 10 comprises an inlet 12, and a front cover 14 of a pump housing 13.

The inlet 12 has a cylindrical shape lengthened in the axial direction of the pump cover 10, and its outer periphery also acts as a fitting part for attaching the washer pump 1 to a reservoir containing a washing agent. The front cover 14 is formed slantwise toward the circumference. The pump case 8 and the pump cover 10 are both molded with synthetic resin, and connected firmly by ultrasonic joining so as to keep airtightness. Thereby, the pump housing 13 is formed by the pump case 8 and pump cover 10.

Figure 3:
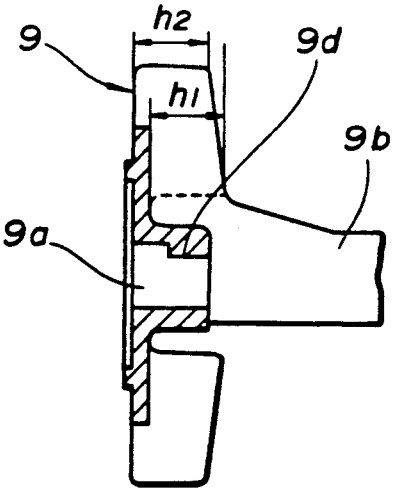
FIGS. 3(*a*) and 3(*b*) are a sectional view and a front view showing the impeller in which flow channels are formed with arcs, respectively.
Figure 3:
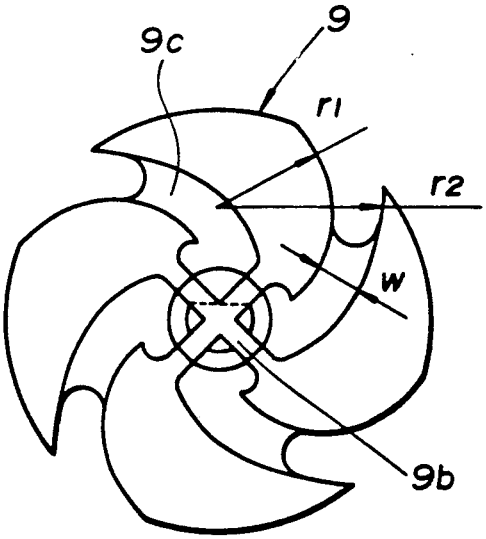
Figure 4:
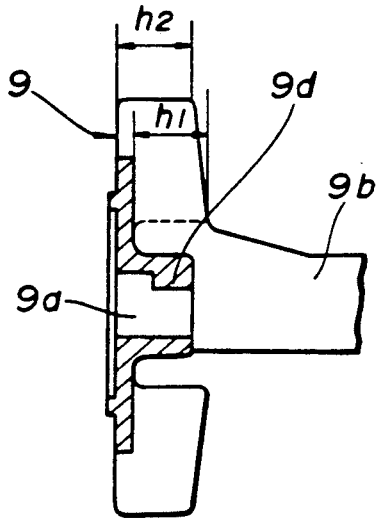
FIGS. 4(*a*) and 4(*b*) are sectional view and a front view showing the impeller in which flow channels are formed with involutes, respectively.
Figure 4:
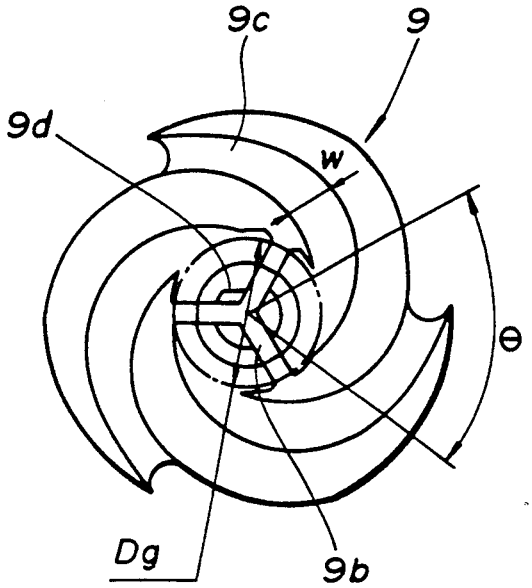
Figure 11A:
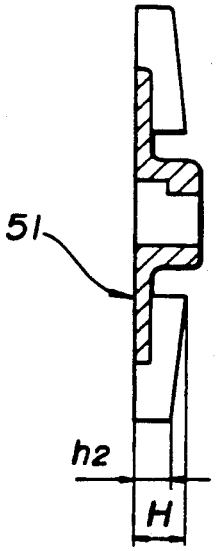
FIG. 11(a) (PRIOR ART)
FIGS. 11(*a*), 11(*b*) and 11(*c*) are sectional views and a front view showing the impeller used for the conventional small-sized centrifugal pump, respectively.
Figure 11B:
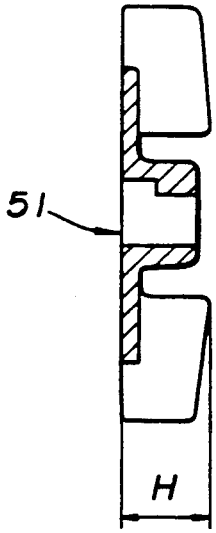
FIG. 11(b) (PRIOR ART)
Figure 11C:
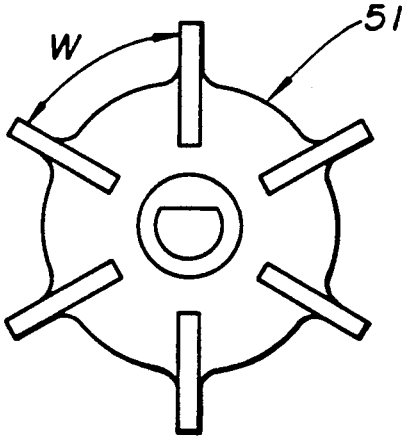
FIG. 11(c) (PRIOR ART)

In the pump-housing 13, the impeller 9 having a shape as shown in FIG. 3 or FIG. 4 is fitted onto the motor shaft 2*a* loosely with play. The impeller 9 is provided with a boss 9*a* to be fitted onto the shaft 2*a*, an auxiliary blade 9*b*, and a flow channel 9*c* formed in the impeller body. Among them, the boss 9*a* is formed with a D-shaped cut 9*d* in order to take the rotating power from the motor part M. The auxiliary blade 9*b* comprises some straight fan blades disposed around the center of impeller 9 in the axial direction, and reaches into the inner part of the inlet 12. The flow channel 9*c* leads from the center portion to the circumference of the impeller body.

In the impeller 9 exemplified in FIG. 3, the flow channel 9*c* has a shape generated by two arcs of coaxial circles having radii r1 and r2. Namely, the width W of the flow channel 9*c* is the difference (r2−r1) between the two rediuses r1 and r2, which is constant substantially from the central portion to the circumferential portion.

In the impeller 9 exemplified in FIG. 4, the flow channel 9*c* has a shape generated by two involutes shifted by prescribed angle $\theta$. Also in this case, the width of the flow channel 9*c* is W ($Dg \times \theta$) indicated with the product of diameter Dg of the base circle and the shift angle $\theta$, which is constant from the center portion to the circumferential portion substantially.

In the both cases of the impeller 9 shown in FIG. 3 and FIG. 4, a ratio ($W/h_1$) of width W to height $h_1$ of the flow channel 9*c* is in the range of 0.5 to 1.2. As to the height of the impeller 9, the height at the center portion is always larger than the height $h_2$ at the circumferential portion, the height of the impeller 9 is decreasing in the circumferential direction from the central portion.

Next, the action of the washer pump 1 will be explained.

The armature 2 is rotated by applying the motor part M with a voltage. The rotation of the armature 2 is transmitted to the impeller 9 by the shaft 2*a* reaching into the pump housing 13 through the water seal 7. The impeller 9 is rotated by fitting the shaft 2*a* into the boss 9*a* of the impeller 9 through the D-shaped cut 9*d*. By the rotation of the impeller 9, the auxiliary blade 9*b* housed in the inlet 12 and immersed in the washing agent gives rotating power to the washing agent, sucks into the inlet 12 and leads the washing agent into the pump housing 13. The washing agent conducted in the pump housing 13 is provided with kinetic energy by the flow channel 9*c* of the impeller 9 on basis of a principle of the centrifugal pump and is sent out to the circumference of the impeller 9, furthermore the washing agent is sent out to the supply system of the washing agent through the outlet 11.

As also described above, because the ratio ($W/h_1$) of the width W to the height $h_1$ of the flow channel 9c is in the range of 0.5 to 1.2, the washing agent flowing in the flow channel 9c is not influenced so much from the side wall of the flow channel 9c due to its viscosity, and the leakage loss from the clearance between the pump housing 13 and the impeller 9 decreases. It is possible to decrease the loss caused by change of the flow channel section, the separation loss, and the circulation loss. Further, although the washing agent is accelarated as approaching to the circumference of the impeller 9 by obtaining the kinetic energy in the flow channel 9c, the separation can be prevented by making the impeller 9 so as to decrease its height in the circumferencial direction.

Figure 5:
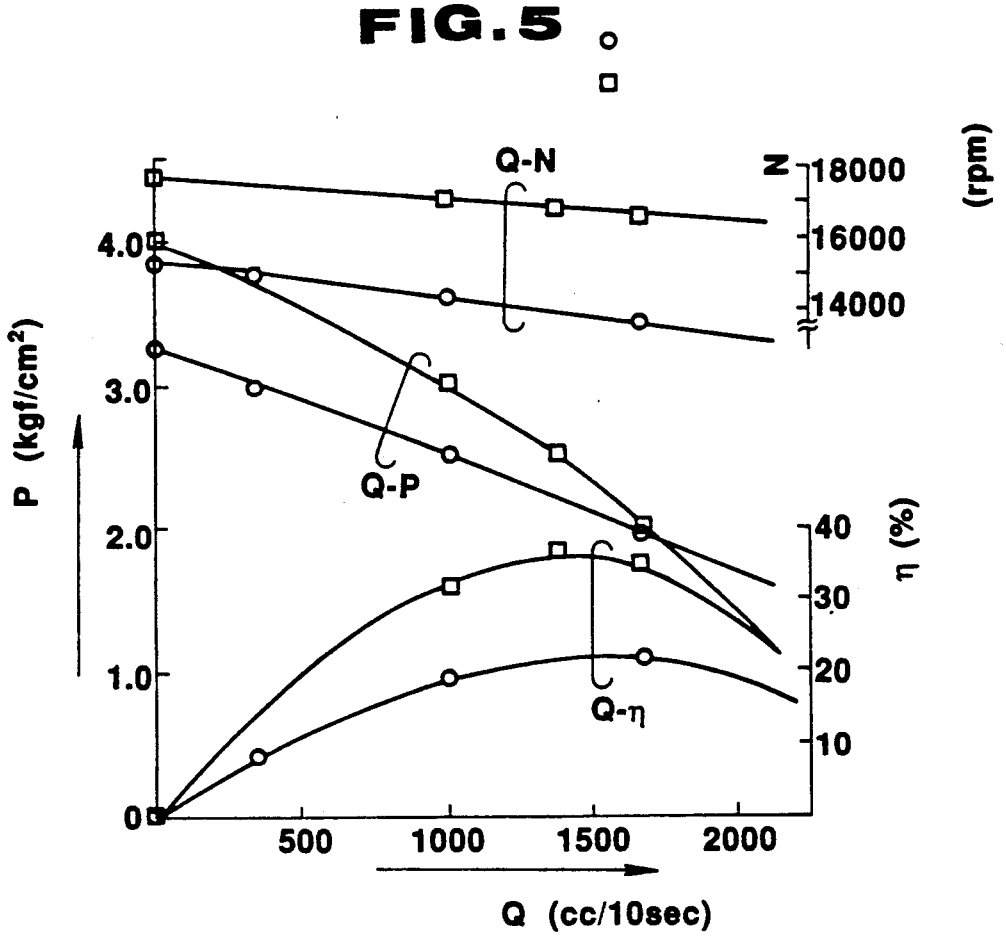
FIG. 5 is a graph showing the pump characteristics of the small-sized centrifugal pump according to this invention as compared with that of conventional small-sized centrifugal pump.

FIG. 5 is a graph illustrating experimental results concerning the pump characteristics. As is obvious from the figure, it is confirmed experimentally that the pump characteristics of the washer pump (small-sized centrifugal pump) according to this invention which are marked with "□" are far advanced as compared with those of the conventional washer pump marked with "○". The efficiency of the pump according to this invention is improved drastically as high as 36% as compared to the efficiency of the conventional pump which is about 23%.

Figure 6:
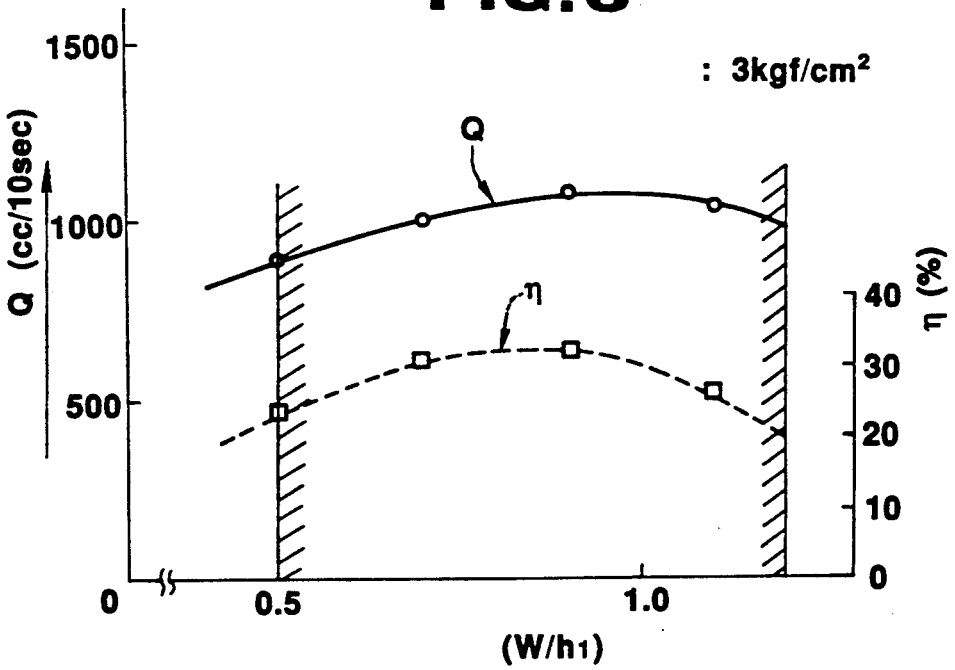
FIG. 6 is a graph showing the relationship between the ratio of the width to the height of the flow channel and the pump characteristics.

FIG. 6 is a graph showing variation of the pump characteristics at the time of changing the ratio of the flow channel section. It is found that the pump efficiency is highest when the ration ($W/h_1$) of the width W to the height $h_1$ of the flow channel 9c is 0.8 or so.

Figure 7:
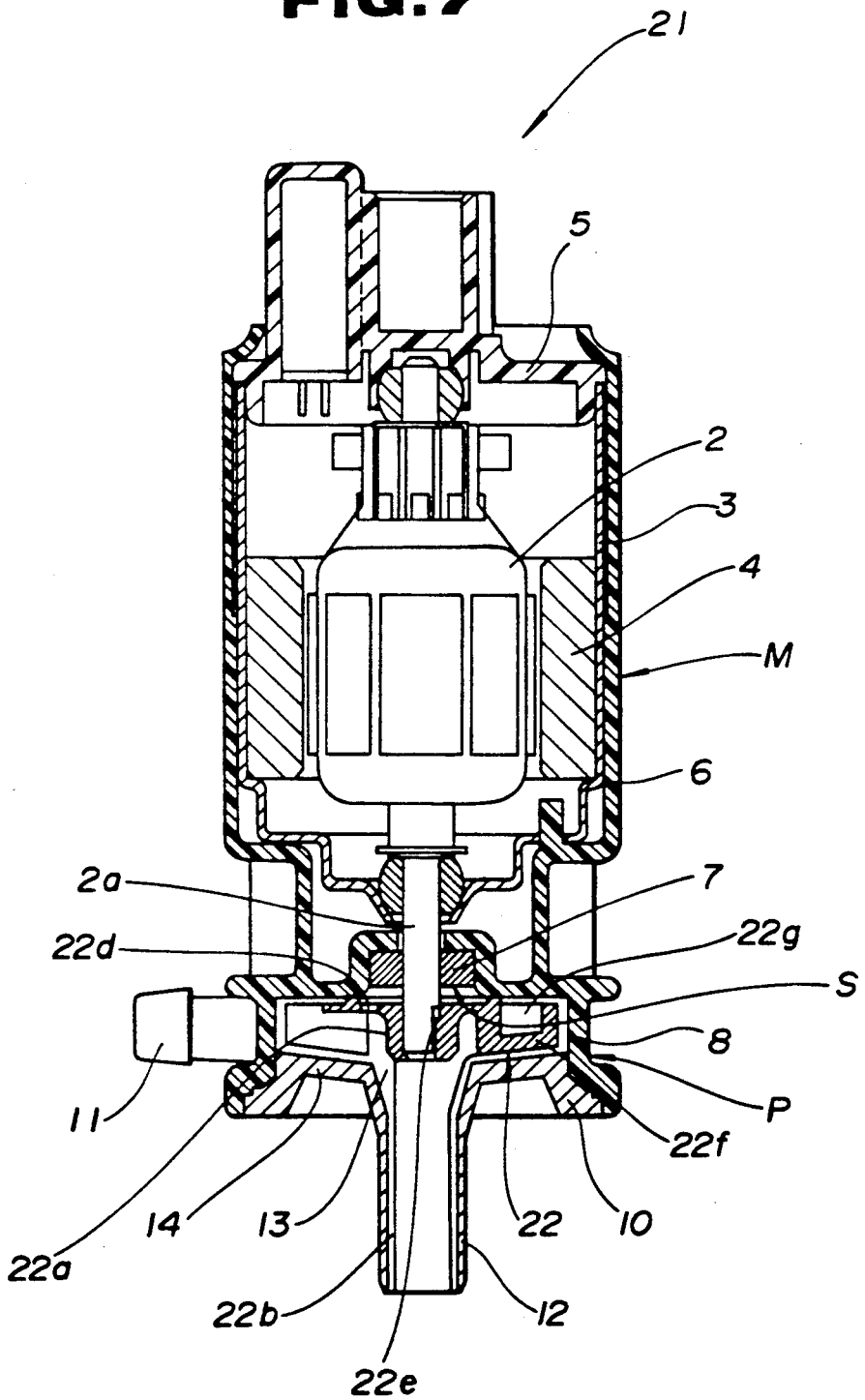
FIG. 7 is a vertical sectional view of the washer pump showing another embodiment of the small-sized centrifugal pump according to this invention.
Figure 8:
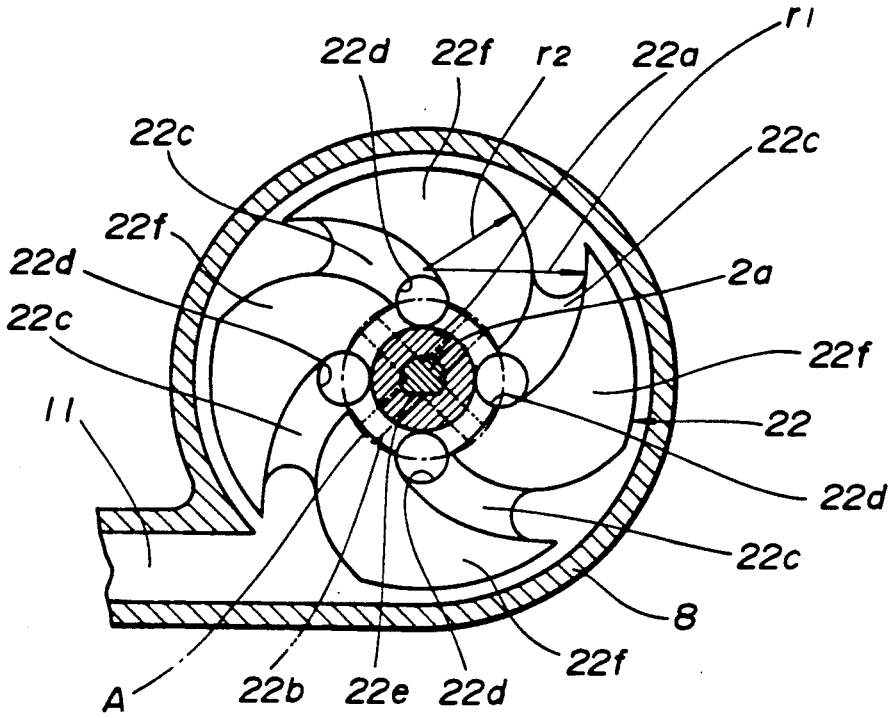
FIG. 8 is a cross-sectional view showing the pump housing of the washer pump shown in FIG. 7.
Figure 9:
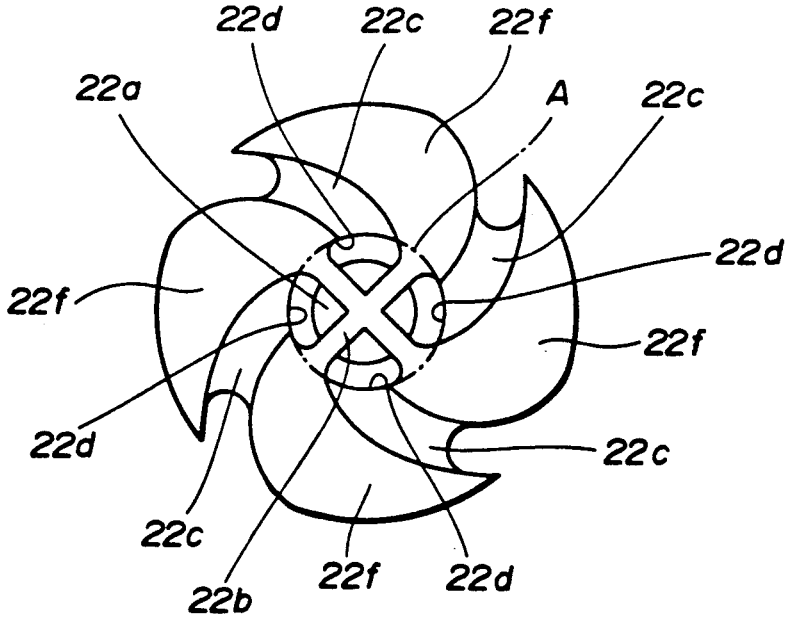
FIG. 9 is a front view showing another example of the impeller having balance holes.

FIG. 7 to FIG. 9 are drawings showing another embodiment of this invention. FIG. 7 is a vertical sectional view of the washer pump showing another embodiment of the small-sized centrifugal pump according to this invention. A washer pump 21 according to this embodiment has a construction similar to that of the washer pump 1 according to the aforementioned embodiment excepting an impeller 22, which is housed in the pump housing 13 formed with the pump case 8 and the pump cover 10 as shown in FIG. 8.

The impeller 22 is provided with a boss 22a, can auxiliary blade 22b (which is shown with two-dot chain lines in FIG. 8), a flow channel 22c similarly to the impeller 9 of the aforementioned embodiment, and with a balance hole 22d provided in the flow channel 22c in addition to above. The flow channel 22c leads from the central portion to the circumferential portion of the impeller body, and has a shape generated by two arcs of coaxial circles having radiuses r1 and r2. The impeller 22 is provided with blades 22f between the flow channels 22c and a lightening hollow 22g (shown in FIG. 7) on the reverse side of the blade 22f. The impeller 22 is also provided with four balance hole 22d at the positions bordered with the boss 22a in this embodiment and so formed as to be passed through and communicate between the front and rear sides of the impeller 22. The total area of these balance hole 22d is in the range of 25% to 50% of an entrance area A (shown with chain lines in FIG. 8 and FIG. 9). In this case, the shape of the balance hole 22d is not restricted only to the circular shape shown in FIG. 8, it may be other shapes such as an elongated circular shape as shown in FIG. 9.

The impeller 22 of the washer pump 21 is rotated by supplying a voltage to the motor part M, and the washing agent in the reservoir is sent out to the supply system for the washing agent according to the action similar to the case of the washer pump 1 explained in the aforementioned embodiment.

At this time, the impeller 22 hardly touches the pump cover 10 even if pressure difference is produced between the front and rear sides of the impeller 22 beacuse it is possible to solve the pressure difference through the balance hole 22d provided around the boss 22a, so that the pump performance never flucutates and the pump efficiency never deteriorates.

Concerning the size of the balance hole 22d, there is the possibility that the fluctuation of the pump performance and the deterioration of the pump efficiency are caused by the sliding resistance produced between the impeller 22 and the pump cover 10 because it is not possible to decrease sufficiently the pressure difference caused in front and in rear of the impeller 22 when the total area of the balance hole 22d is small. Contrary to above, there is also the possibility that the performance and the efficiency of the pump are degraded by drop of the pressure at the center of the impeller 22 on the side of the motor part M and the circumference of the impeller 22 because the washing agent flows into the front side from rear side of the impeller 22, and the washing agent returns to the center portion from the circumferencial portion of the impeller 22, that is, the internal circulation (leakage loss) increases when the total area of the balance hole 22d is too large.

Figure 10:
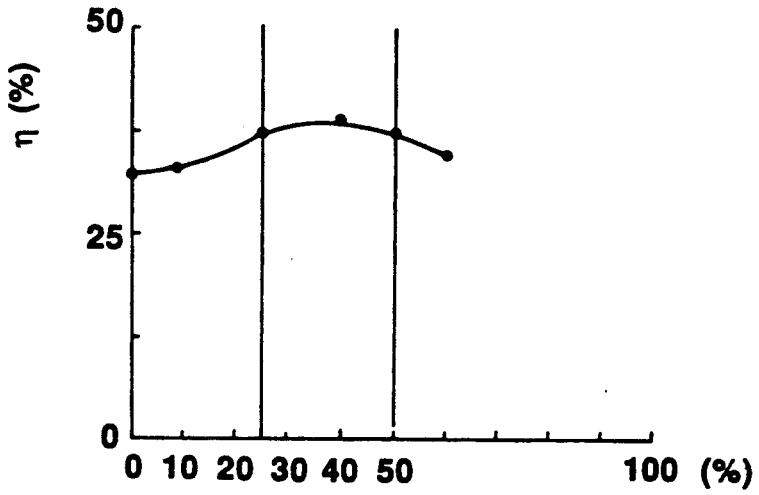
FIG. 10 is a graph showing the relationship between the balance hole size and the pump efficiency.

FIG. 10 is a graph showing the relationship between the pump efficiency and the ratio of the total area of the balance hole 22d to the entrance area of the impeller 22 in the case of varying the total area of the balance hole 22d. It is found that the high efficiency can be obtained when the ratio of the area is in the range of 25% to 50%, in particular, the pump efficiency is improved remarkably when the ratio is 40% or so, as compared with the pump without the balance hole.

As described above, the small-sized centrifugal pump according to this invention is provided with an impeller the height of which is higher than theoretically calculated value and decreases in the circumferential direction from the central portion, and a flow channel which has a narrow and constant width. Therefore, it is possible to reduce a loss in the flow channel drastically in the small-sized centrifugal pump of low-flow rate and high pressure type with low specific speed, and an excellent effect can be obtained so that it is possible to improve the pump efficiency and the performance.

What is claimed is:

1. A centrifugal pump comprising:

a housing having a motor casing and a pump casing;

a motor mounted in said motor casing and having a shaft extending into said pump casing; and an impeller mounted on said shaft in said pump casing for rotation by said motor;

said impeller being provided with vanes having a height decreasing from the height $h_1$ at a center of said impeller to a height $h_2$ at an outer circumference of said impeller and being provided with an entrance having an area A at the center and flow channels having substantially constant width W leading from the center to the outer circumference between adjacent vanes;

wherein a ratio ($W/h_1$) of the width W of said flow channel to the height $h_1$ of said vane at the center of said impeller is in the range of 0.5 to 1.2.

2. A centrifugal pump as set forth in claim 1, wherein each flow channel of said impeller is formed of two arcs of co-axial circles having radii $r_1$ and $r_2$.

3. A centrifugal pump as set forth in claim 1, wherein each of said flow channels of said impeller are formed of two involutes.

4. A centrifugal pump as set forth in claim 1, wherein the height $H_2$ of said vane at the outer circumference of said impeller is in a range from one-seventh to one-fourth of a diameter of said impeller.

5. A centrifugal pump as set forth in claim 1, wherein said impeller is fitted onto said shaft of said motor with movable play in an axial direction.

6. A centrifugal pump as set forth in claim 5, wherein said impeller is provided with at least one balance hole adjacent a boss thereof.

7. A centrifugal pump as set forth in claim 6, wherein a plurality of balance holes are provided having a total area ranging from 25% to 50% of area A of said entrance of said impeller.

* * * * *